US007207895B2

(12) United States Patent
Canakes

(10) Patent No.: US 7,207,895 B2
(45) Date of Patent: Apr. 24, 2007

(54) PUTT TRAINING AND PRACTICE DEVICE

(76) Inventor: Lou Canakes, P.O. Box 692, Hewitt, TX (US) 76643

( * ) Notice: Subject to any disclaimer, the term of this patent is extended or adjusted under 35 U.S.C. 154(b) by 0 days.

(21) Appl. No.: 11/190,055

(22) Filed: Jul. 26, 2005

(65) Prior Publication Data

US 2006/0270493 A1 Nov. 30, 2006

Related U.S. Application Data

(60) Provisional application No. 60/685,804, filed on May 31, 2005.

(51) Int. Cl.
*A63B 69/36* (2006.01)

(52) U.S. Cl. ..... 473/257; 473/266; 473/268

(58) Field of Classification Search ..... 473/219, 473/257, 266, 267–273
See application file for complete search history.

(56) References Cited

U.S. PATENT DOCUMENTS

| | | | | | |
|---|---|---|---|---|---|
| 1,208,995 | A * | 12/1916 | Lyon | ..... | 473/272 |
| 2,790,642 | A * | 4/1957 | Rolfe | ..... | 473/272 |
| 3,658,344 | A * | 4/1972 | Kimble | ..... | 473/272 |
| 5,322,288 | A * | 6/1994 | Amis | ..... | 473/272 |
| 5,398,937 | A * | 3/1995 | Regan | ..... | 473/257 |
| 6,945,875 | B2 * | 9/2005 | Gauer | ..... | 473/270 |

* cited by examiner

*Primary Examiner*—Nini F. Legesse
(74) *Attorney, Agent, or Firm*—Marcus W. Hammack

(57) ABSTRACT

A golf putting and practice aid, which is a flat device having a pointer portion, a long shaft, a fin-shaped assembly and an elongate back bar portion, for visualizing, before making a putt, the desired trajectory and golf club head alignment for achieving such trajectory.

2 Claims, 3 Drawing Sheets

PUTT TRAINING AND PRACTICE DEVICE

This is a application filed pursuant to 35 USC 199(e) which claims priority based upon the provisional application Ser. No. 60/685,804 filed May 31, 2005.

BACKGROUND OF THE INVENTION

1. Field of the Invention

The present invention pertains to sport training devices and methods, and in particular to such as relate to golf.

2. Background Information

The basic nature of accurate putting in golf relies on the need of the player to consistently have their putter's club face perfectly straight before, at, and immediately after impact with the ball. If the player turns or pushes the club face at or immediately after impact with the ball, the line or path of the ball will be affected in a negative manner.

There have been many devices designed to help a player develop the habit of hitting the ball with a square club face. Some practice devices were similar to metal framed rectangles which were designed to force a straight swing backwards and through the ball while the club face stayed "inside the track." These devices were somewhat large and heavy, but did help the player develop a complete practice stroke.

There have been other more simple devices similar to a long string attached to two tall sticks. The idea was to have the player place the putter and ball under the string and keep the club face straight as you pull it back and through using the string as a guide.

There have also been putters (not separate devices) produced in all kinds of shapes designed to create a physical and visual enhancement of the need to keep the putter face straight at impact.

The majority of these items or devices focus on only one aspect of the putting game, are not portable, and do not help to establish a practical and effective putting routine, which are all important to good putting.

SUMMARY OF THE INVENTION

In view of the foregoing, it is an object of the present invention to provide an effective golf training and practice tool.

It is another object of the present invention to provide a golf training and practice tool which facilitates visualization of steps necessary for optimal putting.

In satisfaction of these and other related objectives, Applicant's present invention provides a unique and effective device which not only helps to promote a square club face at impact, but also offers visual reinforcement to allow the player to consistently create a complete stroke with a straight path while moving away from the ball and also several inches past impact with the ball moving "down the line." The present inventor's training and practice device ("The device") is a light and portable apparatus which permits use off the course, on the putting greens, and on the course during a practice round.

The Device's unique design provides the player with a multi-tasking tool which can be used on the course, to help, during the continuous play of the game to improve the player's ability to repair divots on the green, mark their ball on the green, line-up their putts, help the player create and establish an effective and repeatable practice putting routine, establish the speed of the putt, and create consistent confident putts and lower scores.

Point (4) of The Device can be used to replace the typical ball marker so that a ball can be lifted/cleaned.

Point (4) of The Device, can be used to repair small ball marks on each green.

While the golf ball is on the green, point (4) can be placed directly behind the ball. The player can then step back and, using the shaft of their putter lined up with T-shaped back bar (1), create a very strong and accurate visual alignment for the player. The Device can be easily moved from left to right in very intricate manipulations to improve even the slightest variation of line.

Through the use of T-shaped back bar (1), the player is able to stand directly behind the ball, and look down fins (2) and shaft (3) of The Device, past point (4), and down the line to visualize the correct path of the ball. The player can then utilize T-shaped back bar (1) of The Device as a guide to keep the club face straight while also looking down the reinforced line and practice the "speed and stroke" of the putt. This quick and easy routine can be repeated quickly and efficiently to help speed up play while maintaining an accurate line, read, and stroke.

The individual elements of The Device, work together to create a series of visual cues that help ensure that the player learns and maintains "the most critical 8" of the proper and straight putting stroke" (in the Standard size model), this number will vary in overall length from (3"–10") depending on which skill level version is used. The Device is actually a system of individual elements designed to work together to, "start the club face square" several inches back from the ball, "keeping the club face square in the "tracking zone" as the club face approaches and strikes the ball, "keeping a straight club face" through the "impact zone" and finally "maintaining a straight club face" for several inches past the point of impact in the "through zone."

This (4) step process utilizes the (4) individual elements of The Device to ensure that a proper and straight putting stroke is maintained well before and well after the ball is hit.

Step 1: T-shaped back bar (1) is used to align and set the putter face straight several inches from the ball (4" according to the preferred mode of the present invention). This back bar provides a strong visual starting point for the stroke. Then as the club face is moved back to initiate the putt, the bar reinforces the straight line as the club face re-approaches it and passes over it.

Step 2: fins (2) offer a strong visual cue that "points the way" for the club head to move on down the line in a straight and precise line toward the ball.

Step 3: shaft (3) offers strong reinforcement and a clearly defined and straight pathway for the club to follow, right up until impact.

Step 4: Point (4) actually points to the center of the ball. It is critical that contact is made in the exact center of the ball to ensure the club makes even contact and creates a straight rolling action on the ball. The tip of Point (4) actually lies "underneath" the ball and touches and the exact spot where the ball rests on the ground. This strategic placement allows the player to actually visualize hitting "into and through" the ball at impact which ensures solid contact and forces the "energy of the stroke" through the ball and sends it straight down the line for several inches "through" the area past the original point of impact.

The (4) individual elements of The Device combine to allow the player to: (1) set-up a perfectly straight club face several inches back from the ball; (2) reinforce the straight club face as the beginning stroke is backed up over it and as it passes over it again; (3) offer visual cues that help keep the club face straight prior to, at, and through impact with the ball; and (4) ensure the club face remains straight after impact.

When all aspects of The Device are used to create a consistent and comprehensive practice routine, the player can then concentrate on the speed and stroke of the club before, at, and after impact. The player can trust the line, the speed, and the stroke and hit the putt without even having to look at the target/cup. This will allow the player to be confident in all aspects of the putt, be "still" over the ball and re-create a nice smooth putt while keeping the head down.

With continued use and practice, The Device will allow the player to retain the knowledge and visual cues because they are so easy and simple "to see" in the mind's eye even if The Device is removed. The Device improves and establishes in the player's "body memory" key elements used in every putt because of the consistent and easy to retain movements stimulated by The Device. This "body memory routine" will be established through proper and continuous use of The Device so that each time a player stands behind the ball they can visualize The Device pointing down the line or helping them to keep the putter face straight because it has been consistently practiced the same way over and over. Even when the physical tool is removed, the routines will remain in the body and the mind.

The overall length of the Standard size of The Device in this drawing is 5" and the overall height is 3".

The Device can be made out of any type of light weight metal, plastic, or aluminum as long as it can remain stable on the surface of the green while putting over the top of it.

The overall standard thickness of The Device is approximately ⅛". The thickness can vary slightly depending on the type of material used, but the purpose is to allow the practice stroke to go over the top of The Device so it cannot be too thick.

Point (or Pointer Member) (4) of The Device, in the Standard "best mode" Model is ¾" long and ½" wide at the base.

Shaft Member (3) of The Device in the Standard "best mode" model is 3 14/32" long and 1 2/32" wide.

Fins (or Fin Assembly) (2) of The Device in the Standard "best mode" model are 1⅜" at the base and 1¾" long running to a point.

T-Shaped Back Bar Member (1) of The Device in the Standard "best mode" model is 3" long and 1 1/32" wide.

Figure 1:
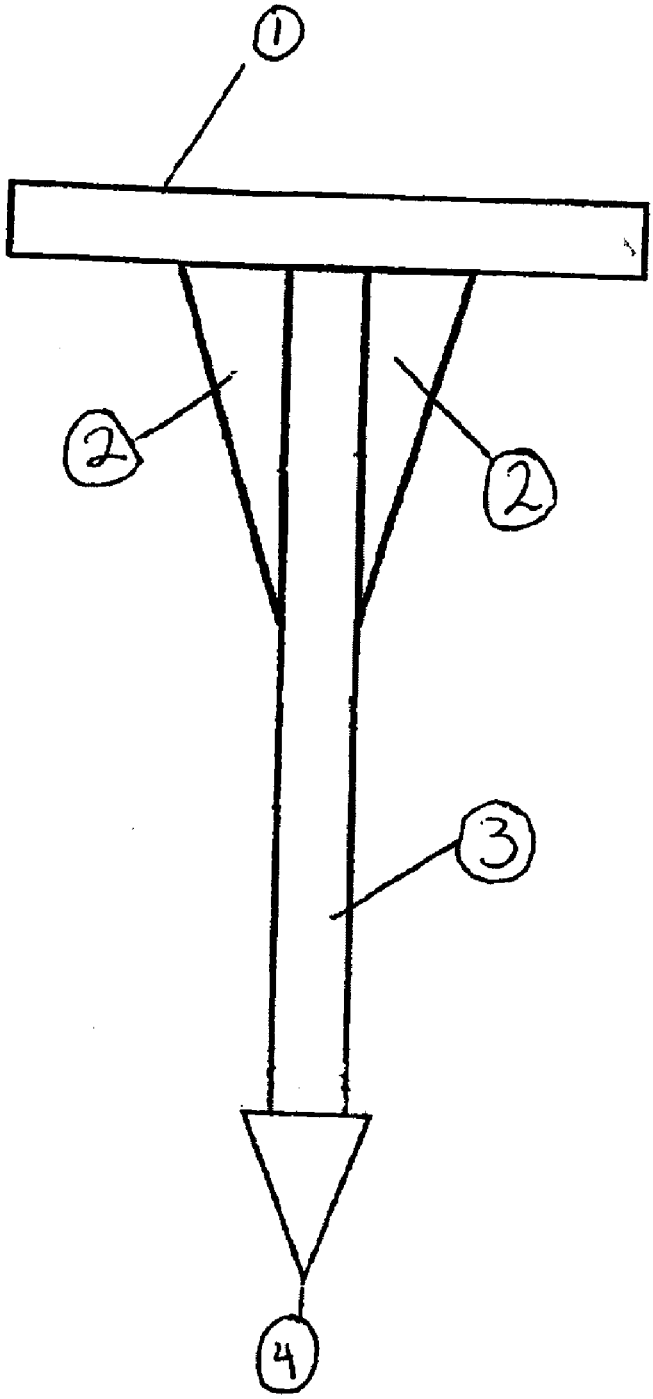
FIG. 1 shows the STANDARD size, shape and dimensions, which represents the "best mode" of The Device.

The Device can be made larger or smaller in equal proportions of length and height, but FIG. 1 outlines the most workable, and "best mode" and Standard size for the average golfer. A proportionally smaller or larger version of The Device can be created and made depending on the skill level of the player. These variations can be charted and tracked using a mathematical formula to even customize The Device in any size requested. The basic elements and dimensions will remain, but the overall effect of changing the overall size can be stated in general terms. In general, any larger mode of The Device will help the beginner, i.e. a larger 8" long by 6" high version, and smaller models of The Device can be used by the more experienced player, i.e. a smaller 3½" long by 1½" high version.

Figure 2:
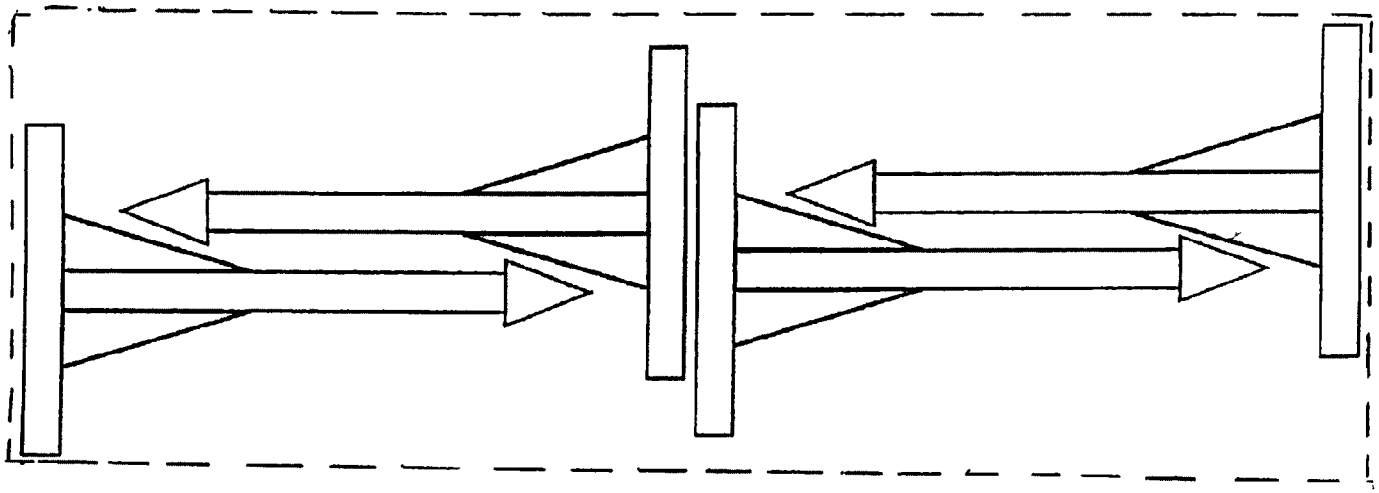

FIG. 2 shows the basic layout of the die-cast that will need to be created in order to mass produce The Device. This die-cast model will be created by grouping (4) individual units together into (1) form. The drawing shown is not to scale and does not represent standard size but represents 83% of the actual size.

Figure 3:
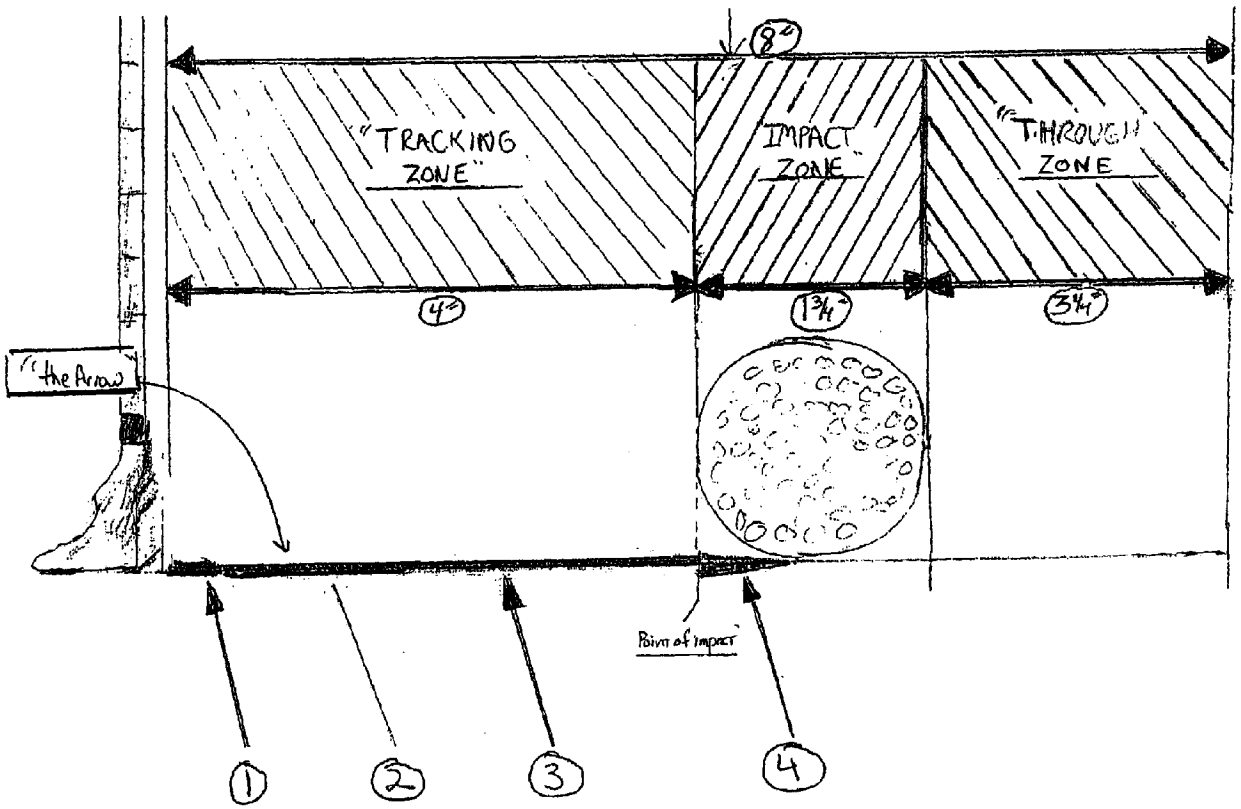

FIG. 3 shows how the (4) individual elements of The Device, work together to create a series of visual cues that help ensure that the player learns and maintains "the most critical 8" of the proper and straight putting stroke" (in the Standard size model), this number will vary in overall length from (3"–10") depending on which skill level version is used. The drawing shows how the (4) elements relate to the (3) separate improvement zones, the tracking zone, the impact zone, and the through zone. The Device is actually a system of elements designed to "start the club face square" several inches back from the ball, "keeping the club face square through the "tracking zone, and again as the club face approaches and strikes the ball, "keeping a straight club face" through the "impact zone" and finally "maintaining a straight club face" for several inches past the point of impact in a "through zone".

DETAILED DESCRIPTION OF THE PREFERRED EMBODIMENT

The Device of the present invention is a light and portable practice tool designed to help a golfer at any level, but especially the amateur to improve their putting and improve their overall game. The design of The Device allows for it to be used off the course, on the putting greens, and actually on the course during a practice round to improve several aspects of a player's putting.

"The Device can be made out of any type of light weight metal, plastic, or aluminum as long as it can remain stable on the surface of the green while the player is putting over the top of it.

The "initial offering" of The Device will be produced in the Standard "best mode" size, and made of brushed gold aluminum on the front and a flat silver color on the back. The Device can be made out of any type of light weight sturdy material and in any color.

The overall thickness of the Standard "best mode" model of The Device is approximately ⅛". The thickness can vary slightly depending on the type of material used, but the purpose is to allow the practice stroke to go over the top of The Device so it cannot be too thick. The player must still be able to strike the ball solidly.

The basic shape of The Device portable practice tool is that of a typical artist's drawing of an arrow complete with a point at one end (front), and a triangle shape that resemble the lines of feathers on the other end (back).

Along the "back" edge of The Device a back bar is added which creates a visual line guide several inches back in the putting stroke. The back edge of the back bar also provides a straight visual reference for the practice stroke while also allowing the player to study the line and terrain of the putt and to practice the speed of the putting stroke along a straight line.

Point (or Pointer Member) (4) of The Device, in the Standard "best mode" Model is ¾" long and ½" wide at the base. The Pointer Member (4) is a substantially flat, planer member with broad, opposite faces, and thin margins which define the outline of the Pointer Member as a substantially arrow-shaped cut-out.

Shaft Member (3) of The Device in the Standard "best mode" model is 3 14/32" long and 12/32" wide. Shaft Member (3) is a substantially flat, planer member with broad, opposite faces, and thin margins which define the outline thereof as an elongate, rectangular member which is "centered on" the Pointer Member (4).

Fins (or Fin Assembly) (2) of The Device in the Standard "best mode" model are 1⅜" at the base and 1¾" long running to a point. Fin Assembly (2) defines a generally, substantially triangular outline and, like the other portions of the Device, is a substantially flat, planer member with broad, opposite faces and is "centered on" the Shaft Member (3) as depicted in the drawings.

T-Shaped Back Bar Member (1) of The Device in the Standard "best mode" model is 3" long and 1 1/32" wide. The T-Shaped Back Bar Member (1) is a substantially flat, planer member with broad, opposite faces, and thin margins which define the outline thereof as an elongate, rectangular member which is "centered on" Fin Assembly (2) as depicted in the drawings.

While the components of the Device have been described above as separate entities, which are attached to each other, in the preferred embodiment, the Device is a unitary, over-all planer structure of which the Pointer Member, the Shaft Member, the Fin Assembly, and the T-shaped Back Bar Member are sub-portions thereof. Therefore, "attachment" or "attached", as used in the claims, or otherwise, can mean either the literal attachment of previously, separately formed components, or may represent transitions from one portion to another of a unitary structure formed at once, such as by die stamping, molding, or the like.

The Device is a unique and effective practice tool which not only helps to promote a square club face at impact, but offers unique visual reinforcement to allow the player to consistently create a straight path while moving away from the ball and also several inches past impact with the ball moving "down the line."

The Device allows the player to mark his/her ball on the putting surface. Point (4) of The Device can be used to replace the typical ball marker so that a ball can be lifted/cleaned.

The device can be used as a divot tool to repair ball marks on the green with the point (4) of The Device being used to repair small ball marks on each green.

A player can use the device to line up the putt (the unique design of The Device, allows the player to use the visual image of an arrow to establish the line of the putt while the ball is on the green. The point (4), can be placed directly behind the ball, with the player stepping back and using the shaft of the putter, lined up with the T-shaped back bar (1), creating a very strong and accurate visual alignment for the player. The Device can be easily moved from left to right in very intricate manipulations to improve even the slightest variation of line.

The device facilitates the creating of an effective and redundant practice routine. Through the use of the T-shaped back bar (1), the player is able to stand directly behind the ball, and look down shaft (3) of The Device, past point (4) and down the line to visualize the correct path of the ball. The player can then utilize the T-shaped back bar (1) as a guide to keep the club face straight while also looking down the reinforced line and practice the "speed and stroke" of the putt. This quick and easy routine can be repeated quickly and efficiently to help speed up play while maintaining an accurate line, read, and stroke.

The four principle elements of The Device work together to create a series of visual cues that help ensure that the player learns and maintains "the most critical 8" of the proper and straight puffing stroke" (in the Standard size model), this number will very in over length from (3"–10") depending on which skill level version is used.

The Device is actually a system of elements designed to "start the club face square" several inches back from the ball, "keeping the club face square and "tracking" as the club face approaches and strikes the ball, "keeping a straight club face" through the "impact zone" and finally "maintaining a straight club face" for several inches past the point of impact in a "through zone".

This four-step process utilizes the (4) individual elements of The Device to ensure that a proper and straight putting stroke is maintained well before and well after the ball is hit:

Step 1: T-shaped bar back (1) is used to align and set the putter face straight several inches from the ball, (4" in the STANDARD size). This bar back provides a strong visual starting point for the stroke. Then, as the club face is moved back to initiate the putt, the bar reinforces the straight line as the club face re-approaches it and passes over it.

Step 2: Fins (2) offer a strong visual cue that "points the way" for the club head to move on down the line in a straight a precise line toward the ball.

Step 3: Shaft (3) offers a strong reinforcement and a clearly defined and straight pathway for the club to follow, right up until impact.

Step 4: Point (4) points to the center of the ball. It is critical that contact is made in the exact center of the ball to ensure the club makes even contact and creates a straight rolling action on the ball. The tip of point (4) actually lies underneath the ball and touches at the exact spot where the ball rests on the ground. This strategic placement allows the player to visualize hitting "into and through" the ball at impact which ensures solid contact and forces the "energy of the stroke" through the ball and sends it straight down the line for several inches "through" the area past the original point of impact.

The elements of the device and associated method of use combine to allow the player to: (1) set-up a perfectly straight club face several inches back from the ball; (2) reinforce the straight club face as the beginning stroke is backed up over it and as it passes over it again; (3) offer visual cues that help keep the club face straight prior to, at, and through impact with the ball; and (4) ensure the club face remains straight after impact The Device facilitates a player remaining "still" over the ball, while keeping his/her head looking down at and through impact. When all aspects of The Device are used to create a consistent and comprehensive practice routine, the player can then concentrate on the speed and stroke of the club before, at, and after impact. The player can trust the line, the speed, and the stroke and hit the putt without even having to look at the target/cup. This will allow the player to be confident in all aspects of the putt, be "still" over the ball and re-create a nice smooth putt while keeping the head down.

With continued use and practice, The Device will allow the player to retain the knowledge and visual cues because they are so easy and simple "to see" in the mind's eye even if The Device is removed. The Device improves and establishes in the player's "body memory" key elements used in every putt because of the consistent and easy to retain movements stimulated by The Device. This "body memory routine" will be established through proper and continuous use of The Device so that each time a player stands behind the ball they can visualize The Device pointing down the line or helping them to keep the putter face straight because it has been consistently practiced the same way over and over. Even when the physical tool is removed, the routines will remain in the body and the mind.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the 6 invention.

I claim:

1. A golf putting practice aid apparatus comprising:

a thin, substantially planer pointer member having first and second pointer member broad faces, a first portion of which pointer member is formed as a substantially pointed apex at one terminus and a relatively broader base and an opposite terminus;

an elongate, substantially rectangular, thin, substantially planer shaft member having first and second shaft member broad faces and first and second shaft member long margins, said shaft member being attached at a first shaft member end to said pointer member whereby a pointer member line of symmetry of said pointer member, when extended through said shaft member, coincides with a coincident long axis and line of symmetry of said shaft member, and whereby said first and second broad shaft member faces are coplaner with said first and second pointer member broad faces;

a thin, substantially planer fin assembly having first and second fin assembly broad faces and being attached to said shaft member, an outline of which fin assembly being substantially triangular in shape, said fin assembly being attached to said shaft member at a second shaft member end whereby a fin assembly line of symmetry of said fin assembly, when extended through said shaft member and said pointer member, coincides with both said shaft member line of symmetry and said pointer member line of symmetry, and whereby said first and second broad fin assembly broad faces are coplaner with said first and second shaft member broad faces; and a substantially rectangular, thin, back bar member having first and second back bar broad faces, first and second long margins and first and second short margins, said back bar member being attached, substantially at a medial point of said first long margin of said back bar member whereby a long axis of said back bar member is substantially perpendicular to a long axis of said shaft member, and whereby to said fin assembly whereby said first and second back bar member broad faces are coplaner with said first and second shaft member broad faces.

2. A method for learning or practicing golf putting comprising the steps of:

selecting a golf putting practice aid comprising:

a thin, substantially planer pointer member having first and second pointer member broad faces, a first portion of which pointer member is formed as a substantially pointed apex at one terminus and a relatively broader base and an opposite terminus;

an elongate, substantially rectangular, thin, substantially planer shaft member having first and second shaft member broad faces and first and second shaft member long margins, said shaft member being attached at a first shaft member end to said pointer member whereby a pointer member line of symmetry of said pointer member, when extended through said shaft member, coincides with a coincident long axis and line of symmetry of said shaft member, and whereby said first and second broad shaft member faces are coplaner with said first and second pointer member broad faces;

a thin, substantially planer fin assembly having first and second fin assembly broad faces and being attached to said shaft member, an outline of which fin assembly being substantially triangular in shape, said fin assembly being attached to said shaft member at a second shaft member end whereby a fin assembly line of symmetry of said fin assembly, when extended through said shaft member and said pointer member, coincides with both said shaft member line of symmetry and said pointer member line of symmetry, and whereby said first and second broad fin assembly broad faces are coplaner with said first and second shaft member broad faces; and a substantially rectangular, thin, back bar member having first and second back bar broad faces, first and second long margins and first and second short margins, said back bar member being attached, substantially at a medial point of said first long margin of said back bar member whereby a long axis of said back bar member is substantially perpendicular to a long axis of said shaft member, and whereby to said fin assembly whereby said first and second back bar member broad faces are coplaner with said first and second shaft member broad faces;

placing said golf putting practice aid atop a putting surface, substantially adjacent to a golf ball which is to be putted;

viewing said golf putting practice aid and alining said shaft member with a desired trajectory of said golf ball, once putted;

selecting a golf club;

during a putting maneuver, moving said golf club substantially along a path defined by said shaft member of said golf putting practice aid while alining said golf club's head substantially in parallel with said back bar member of said golf putting practice aid to putt said golf ball.

* * * * *